US005154412A

United States Patent [19]

Iseda

[11] Patent Number: 5,154,412

[45] Date of Patent: Oct. 13, 1992

[54] AUTOMATIC DOCUMENT FEEDER

[75] Inventor: Ken Iseda, Yokohama, Japan

[73] Assignee: Kabushiki Kaisha Toshiba, Kawasaki, Japan

[21] Appl. No.: 629,677

[22] Filed: Dec. 18, 1990

[30] Foreign Application Priority Data

Dec. 27, 1989 [JP] Japan ..... 1-336682

[51] Int. Cl.[5] ..... B65H 9/00

[52] U.S. Cl. ..... 271/227; 271/233; 271/242; 271/270; 271/186; 271/902

[58] Field of Search ..... 271/227, 233, 242, 246, 271/270, 186, 902

[56] References Cited

U.S. PATENT DOCUMENTS

| | | | |
|---|---|---|---|
| 4,667,951 | 5/1987 | Honjo | 271/270 X |
| 4,739,983 | 4/1988 | Ide | 271/233 |
| 4,836,525 | 6/1989 | Mizuno | 271/186 X |
| 5,043,771 | 8/1991 | Shibata | 271/270 X |

*Primary Examiner*—Richard A. Schacher
*Attorney, Agent, or Firm*—Foley & Lardner

[57] ABSTRACT

A switch is located near a pair of register rollers for feeding a document sheet toward a platen glass. A pair of document-feeding rollers are located near a platen glass. When the switch detects the rear edge of the document sheet being fed by the register rollers, it generates a signal. Upon receipt of this signal, the document-feeding rollers rotate, thus feeding the sheet for a prescribed distance and placing it at a predetermined position on the platen glass. The image on the sheet, thus positioned, is copied. An upper roller and a lower roller contacting each other are arranged at the exit side of the register rollers. The document sheets are braked as they pass, one after another, through the gap between the upper and lower rollers and are fed at the same speed, thus reducing their speeds to one and the same speed in spite of their different inertias. Hence, the switch detects the rear edges of the sheets at regular intevals, and the document-feeding rollers feed each document sheet, exactly for a prescribed distance, thereby placing the sheet at the predetermined position on the platen glass.

10 Claims, 14 Drawing Sheets

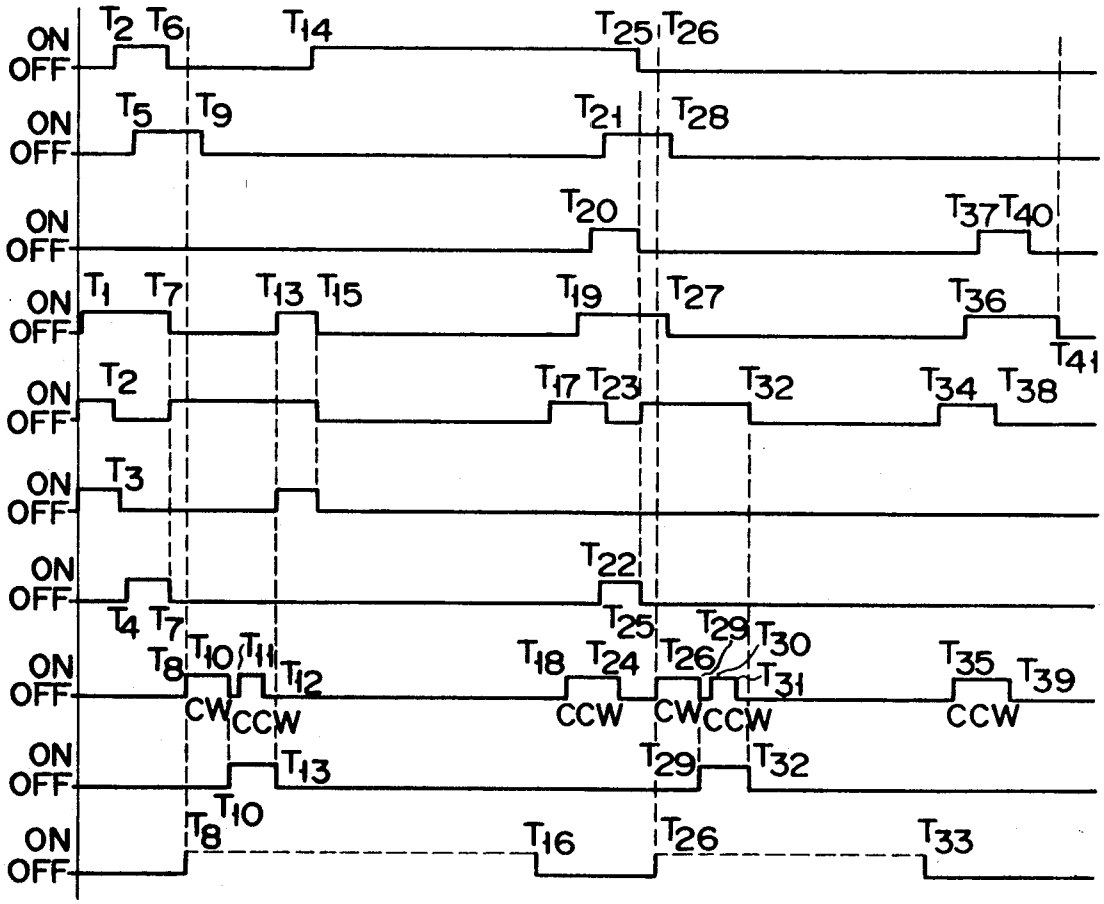
FIG. 13A SWITCH 36
FIG. 13B SWITCH 37
FIG. 13C SWITCH 44
FIG. 13D MOTOR 51
FIG. 13E SOLENOID 97
FIG. 13F SOLENOID 59
FIG. 13G SOLENOID 58
FIG. 13H MOTOR 81
FIG. 13I SOLENOID 117
FIG. 13J COPYING
ON
OFF
CW
CCW

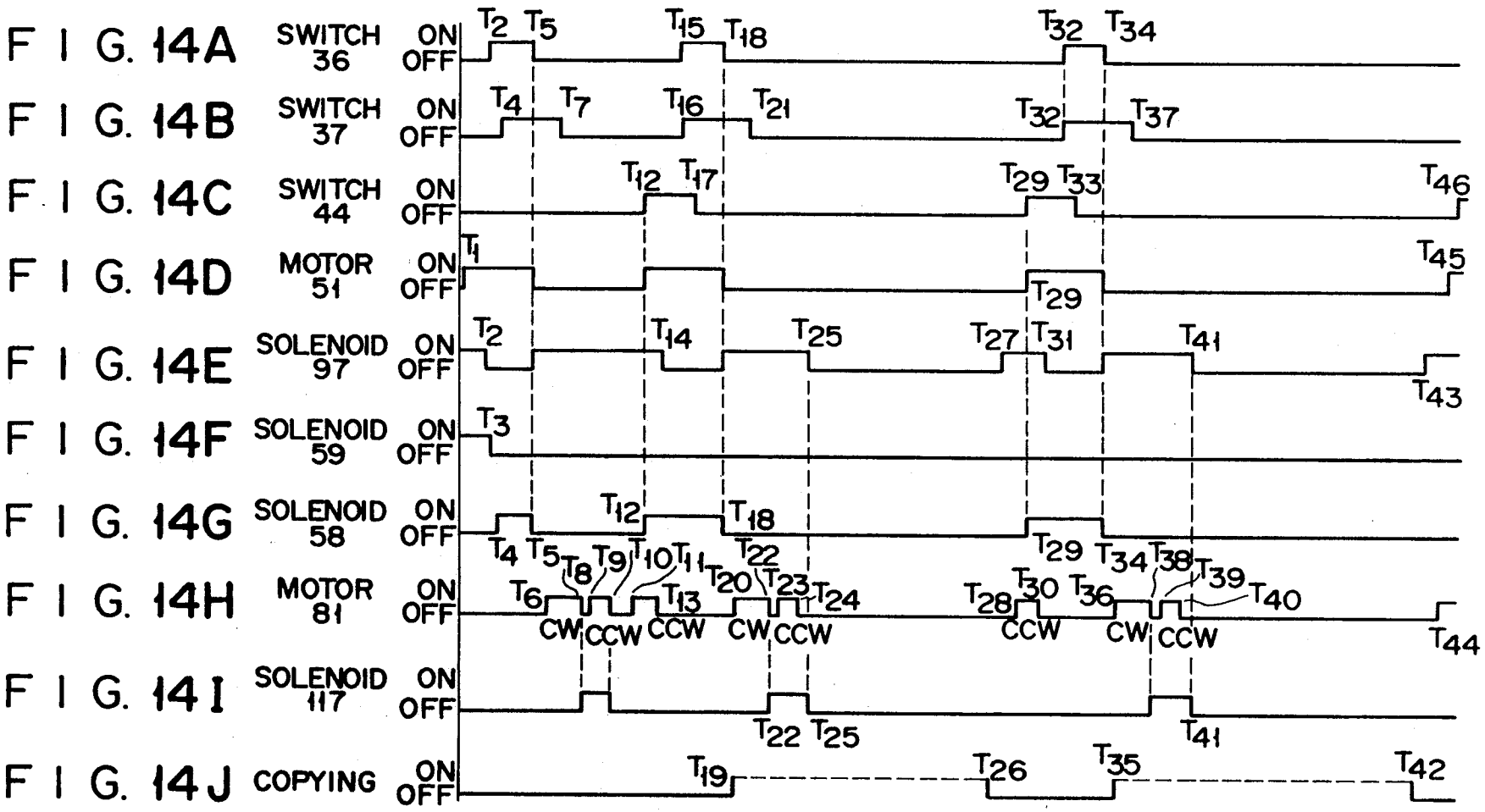
FIG. 14A SWITCH 36
FIG. 14B SWITCH 37
FIG. 14C SWITCH 44
FIG. 14D MOTOR 51
FIG. 14E SOLENOID 97
FIG. 14F SOLENOID 59
FIG. 14G SOLENOID 58
FIG. 14H MOTOR 81
FIG. 14I SOLENOID 117
FIG. 14J COPYING
ON
OFF
CW
CCW

AUTOMATIC DOCUMENT FEEDER

BACKGROUND OF THE INVENTION

1. Field of the Invention

The present invention relates to an automatic document feeder for use in an image forming apparatus such as an electronic copying machine.

2. Description of the Related Art

Various automatic document feeders for use in electronic copying machines have been put to practical use. An automatic document feeder of this type is designed to feed document sheets placed on a tray, one by one, onto the document table (i.e., platen glass) of an image forming apparatus, and also to feed each document sheet from the table after the image formed on the sheet has been copied on a copy sheet. The feeder has a register roller, a document detector, and a feed roller. The register roller is rotated at a high constant speed to feed document sheets one after another toward the table at high speed. The document detector outputs a pulse upon detecting the rear end of any sheet being fed toward the document table. In response to each pulse output by the detector, the feed roller is rotated a predetermined angle and feeds the document sheet for a predetermined distance, thereby placing the sheet at a prescribed position on the document table. The automatic document feeder, however, is disadvantageous due to the following four drawbacks.

First, because the feeder has no means for moderating the inertia of each sheet being fed at high speed by the register roller, document sheets are often fed at different speeds and pass by the detector at irregular intervals. In this case, each sheet cannot be placed at the predetermined position on the document table, and the image on the sheet will inevitably be copied at a wrong position on the copy sheet.

Second, the document cover for holding a document sheet on the document table is expensive because it has a wide endless belt for feeding documents sheets and also a drive mechanism for driving the endless belt. Its cost is more than half the cost of the automatic document feeder as a whole.

Third, since the wide endless belt is put in contact with virtually the entire surface of the document table, the friction between the belt and the table is so great that the drive mechanism consumes much power to drive the endless belt, and the endless belt makes much noise while being driven in contact with the document table.

Fourth, since the document cover contains electric and electronic components, a harness must be used to connect the cover to the image forming apparatus. Due to the use of the harness, it is difficult for remove the cover for inspection and maintenance purposes.

SUMMARY OF THE INVENTION

A first object of the present invention is to provide an automatic document feeder which places a document sheet at a predetermined position on the document table of an image forming apparatus, so that the image formed on the sheet is copied at a correct position on a copy sheet.

A second object of the invention is to provide an automatic document feeder which places a document sheet at a predetermined position on the document table of an image forming apparatus, so that the image formed on the sheet is copied at a correct position on a copy sheet, either in a single-side copying mode or a double-side copying mode.

A third object of this invention is to provide an automatic document feeder which is manufactured at low cost, which consumes little power, which makes little noise, and whose document cover is easily opened, closed, and detached.

A fourth object of the present invention is to provide an automatic document feeder which feeds document sheets out of an image forming apparatus, without causing the sheets to abut on the sheet-registering means of the image forming apparatus.

To achieve the objects of the invention, there is provided an automatic document feeder comprising:

first means for feeding document sheets, one by one, from a document-containing portion;

means for guiding the document sheets fed by said first feeding means;

second means for feeding the document sheets through said guiding means, so as to exert inertia on each document sheet;

means for supporting each of the document sheets fed by said second feeding means;

means for automatically pressing onto said supporting means each document sheet fed by said document-feeding means, said pressing means opposing said supporting means;

means for detecting the following edge of each document sheet fed in a first direction by said second feeding means and for generating a signal upon detecting the following edge of the document sheet, said detecting means being located near said second feeding means;

third means for feeding at a predetermined position in a second direction against the first direction, after the document sheets fed by said second feeding means, onto said supporting means, in accordance with the signal generated by said detecting means; and means for braking the inertia of each document sheet, said braking means being located at an exit side of said second feeding means.

The first feeding means feeds the document sheets from the document-containing portion, one by one, into the document-feeding guiding means. The second feeding means feeds each document sheet to the document-supporting means. The detecting means detects the rear end of the sheet, and generates a signal. Upon receipt of this signal, the third feeding means further feeds the sheet for a predetermined distance, thereby placing the sheet at the predetermined position on the document-supporting means, whereupon the image on the document sheet can be copied.

The braking means, located at the exit side of the second feeding means, applies a braking force on the document sheet being fed at high speed and thus having a great inertia, such that the rear edges of the sheets pass by the detecting means at regular intervals. Hence, the third feeding means can feed the sheets for the same distance, thereby placing each sheet at the predetermined position on the document-supporting means. Since the sheet is correctly positioned, the image on it can be copied entirely, and the copied image will not skewed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out i the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 13A to 13J are a timing chart explaining how the automatic document feeder operates when the image forming apparatus is set in the single-side copying mode; and FIGS. 14A to 14J are a timing chart explaining how the automatic document feeder operates when the image forming apparatus is set in the double-side copying mode.

DETAILED DESCRIPTION OF THE PREFERRED EMBODIMENT

An automatic document feeder, which is an embodiment of the present invention, will now be described, with reference to the accompanying drawings.

Figure 1:
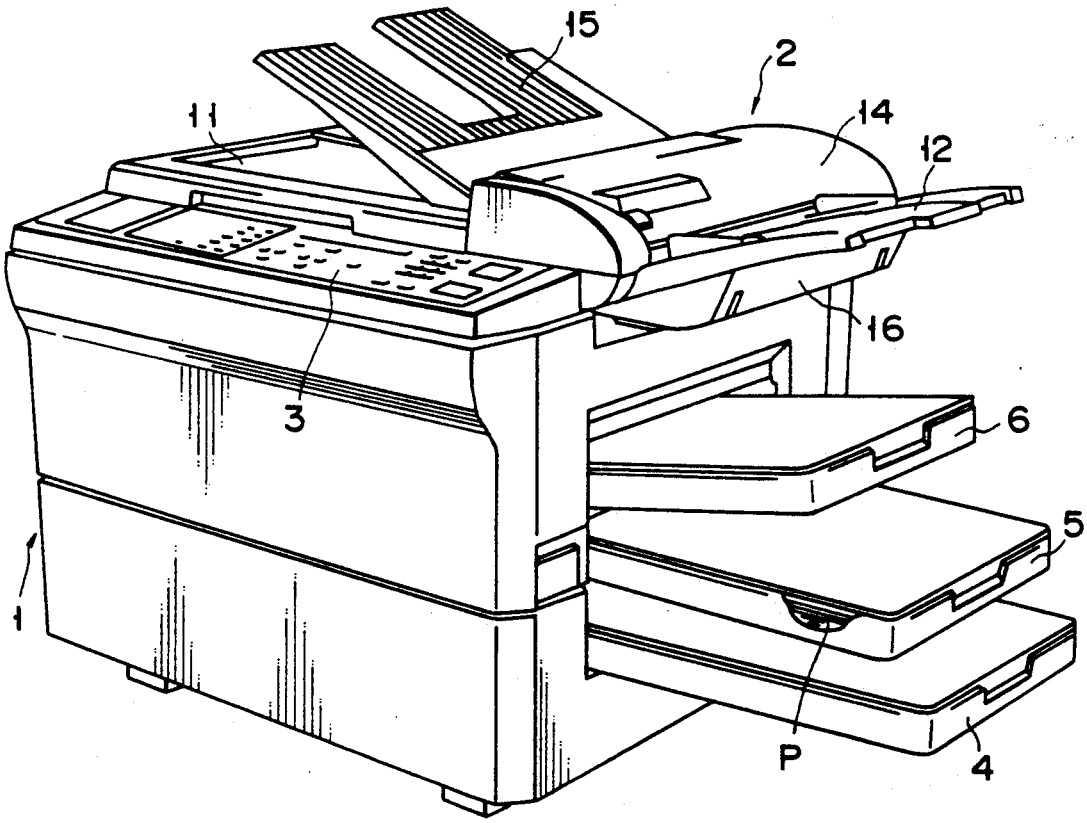
FIG. 1 is a perspective view showing an image forming apparatus comprising an automatic document feeder according to the present invention.

FIG. 1 shows an image forming apparatus comprising the automatic document feeder of the present invention. The apparatus contains an image-forming system (not shown) which performs a sequence of image-forming steps of charging a photosensitive drum, exposing the drum to light, developing a toner image on the drum, transferring the image to a copy sheet, cleaning the drum, and fixing the image on the copy sheet.

The automatic document feeder 2 is mounted on the top of the housing 1 of the image forming apparatus. An operation panel 3 is located on the front-top portion of the housing 1. Arranged on the panel 3 are: a ten-key pad, an instruction display, and various operation keys including a copy key.

Three sheet cassettes 4, 5, and 6 are attached to the right side of the housing 1, partly inserted into the housing 1 and horizontally extending one upon another. Each of these sheet cassettes contains a stack of copy sheets P. A tray (not shown) is attached to the left side of the housing 1, for receiving copied sheets P.

Figure 2:
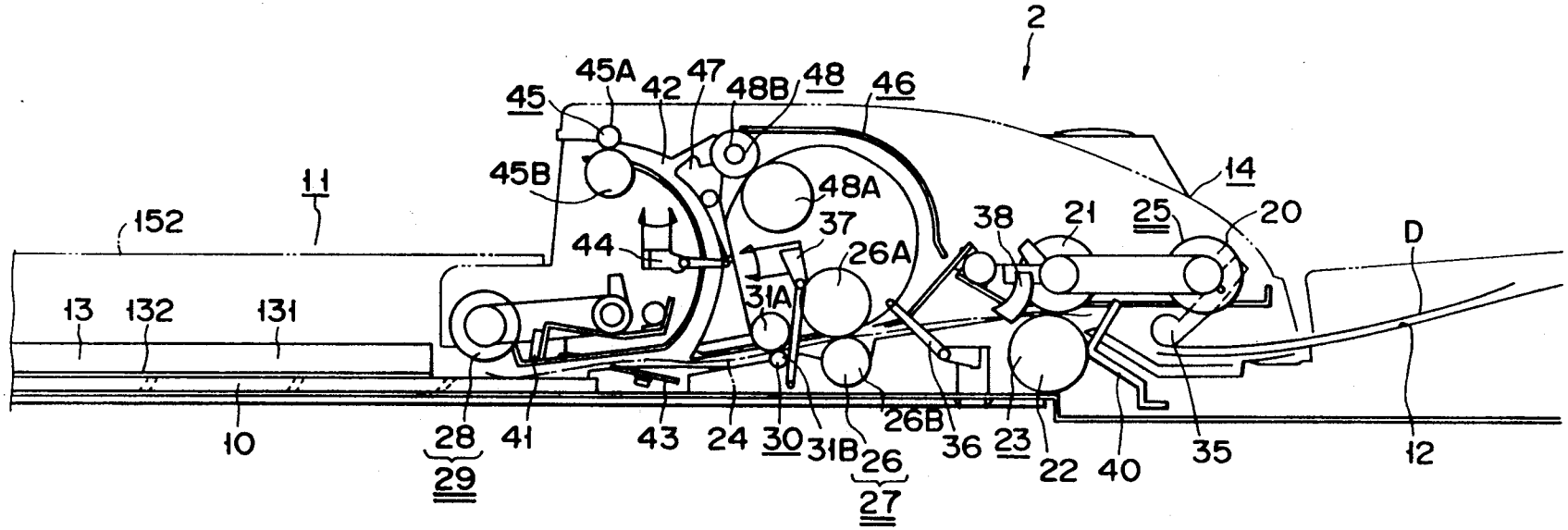
FIG. 2 is a sectional front view illustrating the major components of the automatic document feeder.

As is shown in FIG. 2, a document table 10 (hereinafter referred to as "platen glass"), which is a glass plate, extends horizontally and defines the top surface of the housing 1.

As is shown in FIGS. 1 and 2, the automatic document feeder 2 comprises a document cover 11, a first tray 12, a document holder 13, a document-feeding section 14, a second tray 15, and a control section 16. The document cover 11 is hinged to the top of the housing 1 and can be opened and closed. The first tray 12 is attached to the right side of the housing 1 and horizontally extends above the uppermost sheet cassette 6, and holds a stack of document sheets D which are to be copied. The document-feeding section 14 is located on the top of the housing 1, and positioned to the left of the first tray 12, for feeding the document sheets D, one by one, from the first tray 12 into the gap between the platen glass 10 and the document holder 13 (hereinafter referred to as "platen sheet") attached to the lower side of the document cover 11, and also for feeding each document sheet D from said gap onto the second tray 15. The second tray 15 is attached to the upper surface of the document cover 11 and is inclined thereto at a predetermined angle, for receiving the document sheets D which the section 14 has ejected from the platen glass 10. The control section 16 is attached to the right side of housing 1 and located below the first tray 12.

The document-feeding section 14 will be described in detail, with reference to FIGS. 2 and 3.

Figure 3:
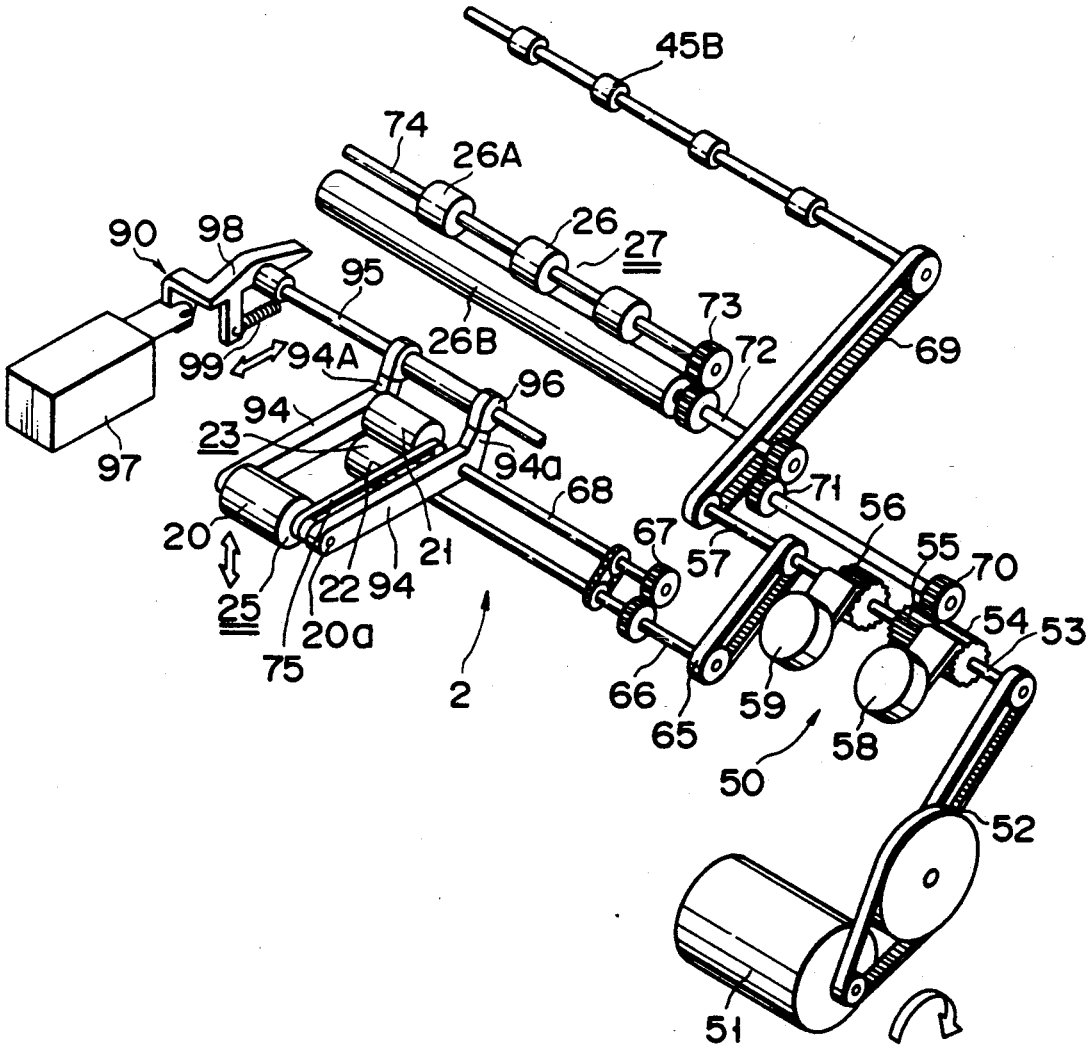
FIG. 3 is a perspective view showing the rollerdriving mechanism which is incorporated in the automatic document feeder, for driving various rollers to feed document sheets to and from the document table of the apparatus shown in FIG. 1.

As is illustrated in FIGS. 2 and 3, the section 14 comprises a pick-up roller 20 located near the exit side of the first tray 12, and a document separating means 23 located near the pick-up roller 20. The pick-up roller 20 is set in contact with the uppermost one of the document sheets D placed on the first tray 12. When driven, the roller 20 feeds the uppermost document sheet D from the tray 12. The document separating means 23 comprises a document-feeding roller 21 and a document-separating roller 22. The roller 21 is driven in forward direction to feed the sheet D fed by the pick-up roller 20 from the tray 12. The document-separating roller 22 is located below the document-feeding roller 21 and driven in the reverse direction, thereby to prevent the second uppermost sheet D from being fed along with the uppermost document sheet D. The pick-up roller 20 and the document separating means 23 constitute a first feeding unit 25 which feeds the documents sheets D, one by one, from the first tray 12 into a document path 24.

In the document path 24, a register roller means 26 is located near the first feeding unit 25. The means 26 comprises a lower roller 26A and 26B a plurality of upper rollers 26A. The register roller means 26 functions as a second document feeding unit 27 which feeds every document sheet D fed by the first document feeding means 25 into the gap between the platen glass 10 and the movable platen sheet 13.

Figure 4:
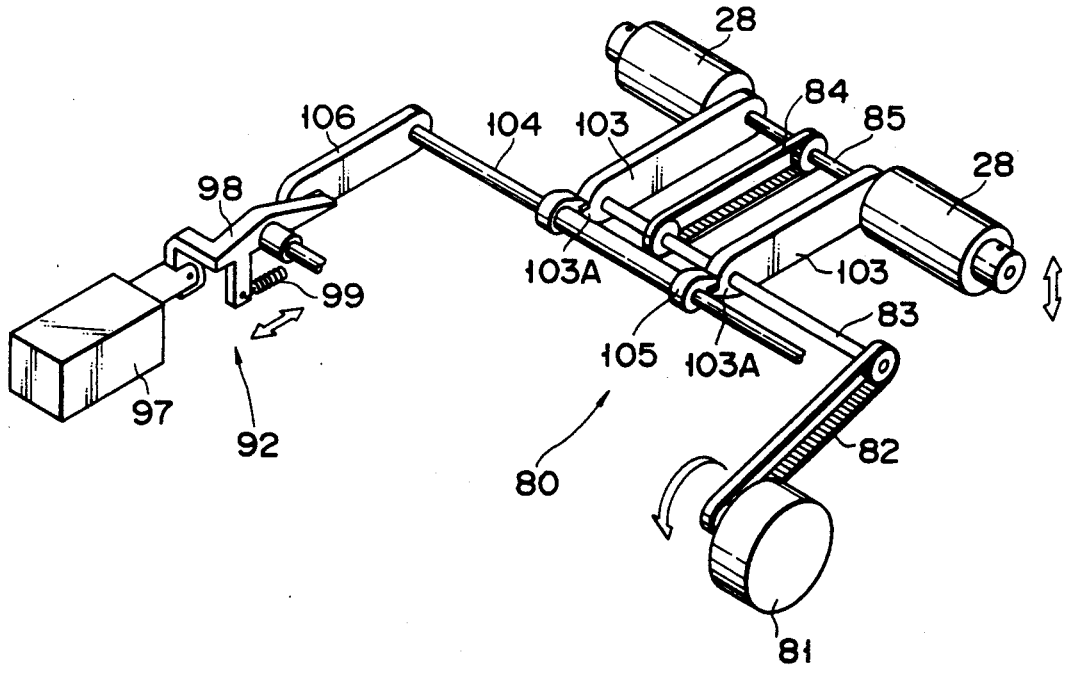
FIG. 4 is a perspective view showing a system incorporated in the automatic document feeder, for transmitting a drive force to document-feeding rollers.

As is shown in FIGS. 2 and 4, a pair of document-feeding rollers 28 are arranged at the end of the document path 24. The rolers 28 oppose the platen glass 10. These rollers 28 function as a third document feeding unit 29 for feeding every document sheet D fed by the second document feeding unit 27 to a prescribed position on the platen glass 10.

As is illustrated in FIG. 2, a brake unit 30 is located near the exit of the second document feeding unit 27 (i.e., the register roller means 26). The brake unit 30 comprises an upper roller 31A and a lower roller 31B. As each document sheet D passes through between these rollers 31A and 31B, it is braked, thus having its inertia killed.

As is shown in FIG. 2, an empty switch 35 is provided in the vicinity of the pick-up roller 20. The switch 35 detects the presence or absence of a document sheet D at the pick-up roller 20.

A register switch 36 is arranged between the document separating means 23 and the register roller means 26. Also, a first document-end detecting switch 37 is located near the exit of the register roller means 26. Further, a second document-end detecting switch 38 is located near the exit of the document separating means 23.

A first document stopper 40 is arranged at the entrance to the document separating means 23, for positioning each document sheet D in the first tray 12. A second document stopper 41 is located at the entrance to the third document feeding unit 29. The second document stopper 41 serves as a scale means for positioning each document sheet D.

A document ejecting path 42 extends upwards from a position between the first document-end detecting switch 37 and the document-feeding rollers 28. The document ejecting path 42 is defined by an arcuate plate and designed to guide each document sheet D from the platen glass 10 into the second tray 15 (see FIG. 1) as the document-feeding rollers 28 are rotated in reverse direction.

An inverter 43, which functions as a first guide means, is located at the position where the document ejecting path branches from the document path 24. A gate switch 44 is arranged in the document ejecting path 42, for detecting jam of document sheets D. Further, a document ejecting roller means 45 is arranged at the end of the document ejecting path 42. The roller means 45 comprises an upper roller 45A and a lower roller 45B. The roller means 45 functions as a fourth document feeder unit.

A document-returning path 46, which is gently curved, branches from the document ejecting path 42, at a position between the gate switch 44 and the document ejecting roller means 45. This path 46 extends to the entrance to the register roller means 26 which is arranged in the document path 24.

A sorting gate 47 is provided at the position where the document-returning path 46 branches from the document-ejecting path 42. A document-feeding roller 48A and a holding roller 48B are located near the sorting gate 47. These rollers 48A and 48B extend parallel to one another, and constitute a fifth document feeding unit.

With reference to FIG. 3, a first drive mechanism 50 will be described which is designed to drive the pick-up roller 20, the document-feeding roller 21, the document-separating roller 22, the register roller means 26, and the lower roller 45B of the document ejecting means 45. In FIG. 3, the lower-left part is the front of the automatic feeder 2, and the upper-right part is the rear of the feeder 2.

The drive force of an electric motor 51 is transmitted to a driving shaft 53 by means of a transmission means 52. The driving force of the shaft 53 is transmitted to a gear 55 through a first clutch 54 provided from the register roller means 26. It is also transmitted to a shaft 57 through a second clutch 59 provided for the document-feeding roller 21. The first clutch 54 is set when a register solenoid 58 is turned on, and released when the solenoid 58 is turned off. Similarly, the second clutch 56 is set when a document-feeding solenoid 59 is turned on, and released when the solenoid 59 is turned off.

The driving force of the shaft 57 is transmitted to a shaft 66 by means of a first transmission system 65 which comprises two pulleys and an endless belt. The document-separating roller 22 is connected to the shaft 66 by a torque limiter (not shown). The driving force of the shaft 66 is transmitted to a shaft 68 by means of a second transmission system 67 which comprises a pair of gears, a pair of sprockets, and an endless chain. The document-feeding roller 21 is mounted on the shaft 68.

The driving force of the shaft 57 is transmitted to the lower roller 45B of the document ejecting means 45 by means of a third transmission system 69 which comprises two pulleys and an endless belt.

The driving force of the gear 55, which is connected to or disconnected from the shaft 53 by the first clutch 54, is transmitted to a shaft 72 by means of a fourth transmission system 71 which has a gear 70 in mesh with the gear 55, a shaft, and another gear. The lower roller 26B of the register roller means 26 is mounted on the shaft 72. The driving force of the shaft 72 is transmitted to a shaft 74 by a fifth transmission system 73 which comprises a pair of gears. The upper roller 26A of the register roller means 26 is mounted on the shaft 74.

The driving force of the shaft 68 of the document-feeding roller 21 is transmitted to a shaft **20*a* by means of a sixth transmission system 75 which comprises two pulleys and an endless belt. The pick-up roller 20 is mounted on the shaft 20*a***.

With reference to FIG. 4, a second drive mechanism 80 will be described which is designed to drive the document-feeding rollers 28. In FIG. 4, the lower-left part is the rear of the automatic feeder 2, and the upper-right part is the front of the feeder 2.

The driving force of an electric motor 81 is transmitted to a shaft 83 by a seventh transmission system 82 which comprises two pulleys and an endless belt. The driving force of the shaft 83 is transmitted to a shaft 85 by means of an eighth transmission system 84 which comprises two pulleys and an endless belt. The document-feeding rollers 28 are mounted on the shaft 85.

Figure 5:
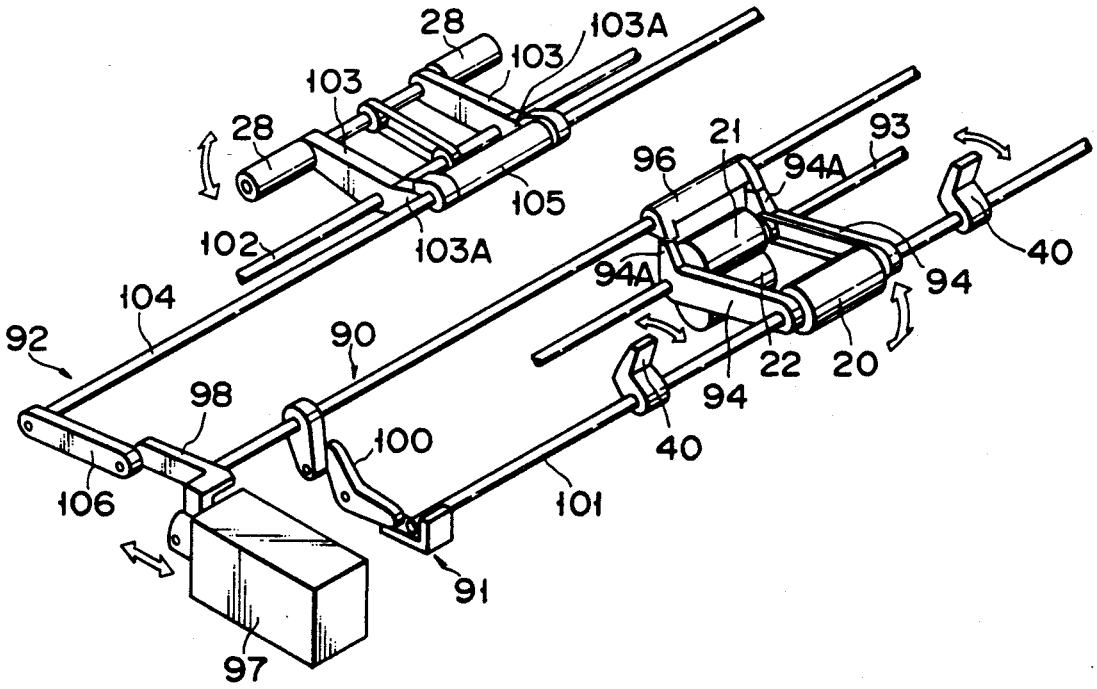
FIG. 5 is a perspective view of a mechanism incorporated in the automatic document feeder, for moving rollers and document stoppers up and down.

A drive mechanism 90 for moving the pick-up roller 20, a drive mechanism 91 for moving the first document stopper 40, and a drive mechanism 92 for moving the document-feeding rollers 28 will now be described, with reference to FIGS. 3 and 5.

The drive mechanism 90, which is designed to move the pick-up roller 20, will be described first. As is illustrated in FIG. 5, the pick-up roller 20 is supported between the free ends of a pair of arms 94. The proximal ends of these arms 94 are rotatably mounted on a shaft 93. A projection 94A protrudes from the proximal end of either arm 94. The projections 94A of the arms 94 can engage with cam 96 which is mounted on a shaft 95. A lever 98 is fastened to one end of the shaft 95. The lever 98 can be rotated by a pick-up solenoid 97. As is shown in FIG. 3, a coil spring 99 is stretched between the shaft 95 and a projection protruding downward from the lever 98. The spring 99 biases the lever 98 in such a direction that the pick-up roller 20 is located in its higher position.

When the solenoid 97 is turned on, the lever 98 is rotated in the opposite direction against the force of the spring 99. As a result, the cam 96 is rotated, leaving the projections 94A of the arms 94. Hence, the pick-up roller 20 moves down by its own weight, thus going into rolling contact with the uppermost document sheet D in the first tray 12.

The drive mechanism 91, which is designed to move the first document stopper 40, will now be described. The driving force of the shaft 95 is transmitted to a shaft 101 by means of a link mechanism 100, as can be understood from FIG. 5. The first document stopper 40 is rotatably mounted on the shaft 101.

The drive mechanism 92, which is designed to move the document-feeding rollers 28, will be described. As is shown in FIG. 5, both rollers 28 are fastened to the ends of a shaft 102, respectively. The shaft 102 is rotatably supported by the free ends of a pair of arms 103. A projection 103A protrudes from the proximal end of either arm 103. The projections 103A of the arms 103 can engage with a cam 105 integrally formed with a shaft 104. A link 106 connects this shaft 104 to the lever 98 which can be rotated by the solenoid 97.

When the solenoid 97 is turned on, thus rotating the lever 98 against the force of the coil spring 99, the cam 105 is rotated, moving away from the projections 103A of the arm 103. As a result of this, both document-feeding rollers 28 move down by their own weight, until they touch the document sheet D placed on the platen glass 10.

The automatic document feeder 2 further comprises another drive mechanism 110 for moving the second document stopper 41 which serves, as has been described, as a scale means for positioning each document sheet D. This mechanism 110 will be described, with reference to FIGS. 6, 7, 8A, and 8B.

Figure 6:
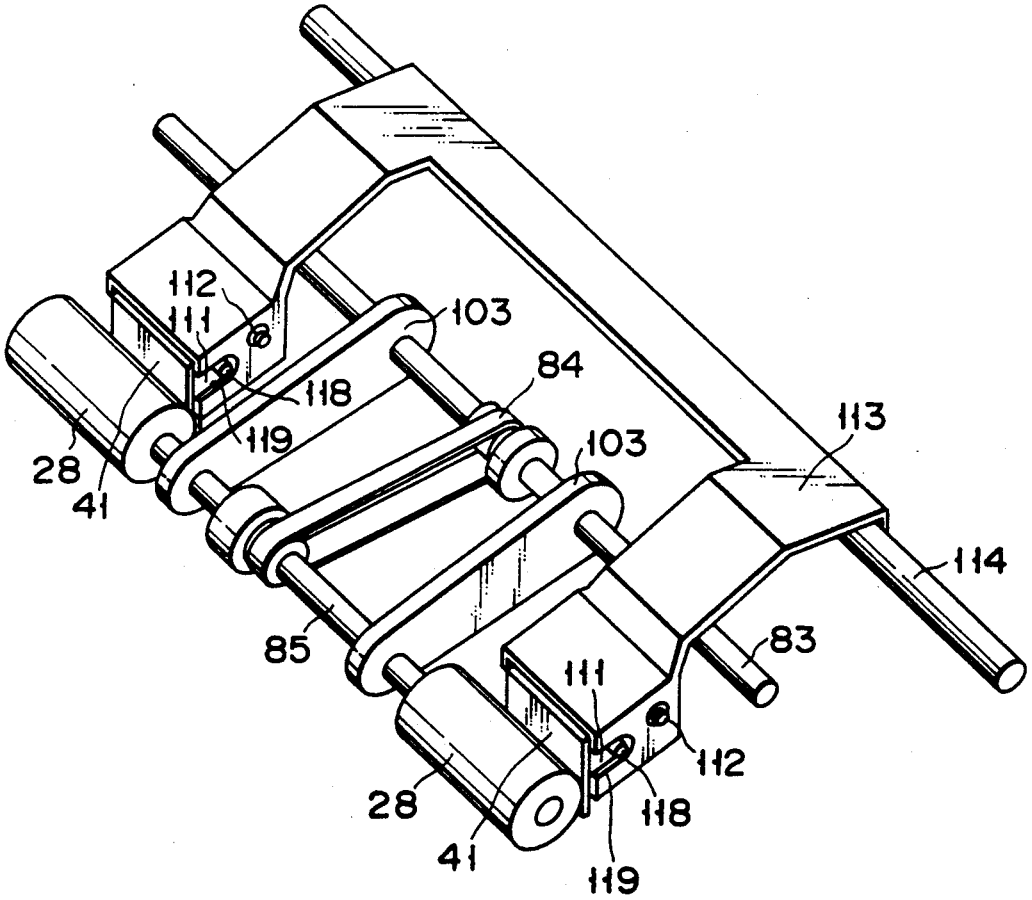
FIG. 6 is also a perspective view representing the positional relationship between the document-feeding rollers on the one hand, and the second document stopper on the the other.

As is evident from FIG. 6, the second document stopper 41 is attached to a holder 111. The holder 111 is fastened by an axle 112 to the free end of a movable member 113. The movable member 113 is coupled to a shaft 114. This shaft 114 is connected to a solenoid 117 by means of a transmission 116 including a link mechanism 115. The plunger 117A of the solenoid 117 is moved back and forth in the direction of opposite arrows A shown in FIG. 7 as the solenoid 117 is turned on and off. The transmission 116 converts the linear motion of the plunger 117A into the rotation of the movable member 113. As the member 113 rotates in the directions of opposite arrows B (see FIG. 7), the second stopper 41 goes into, and comes out of, contact with the platen glass 10.

Figure 7:
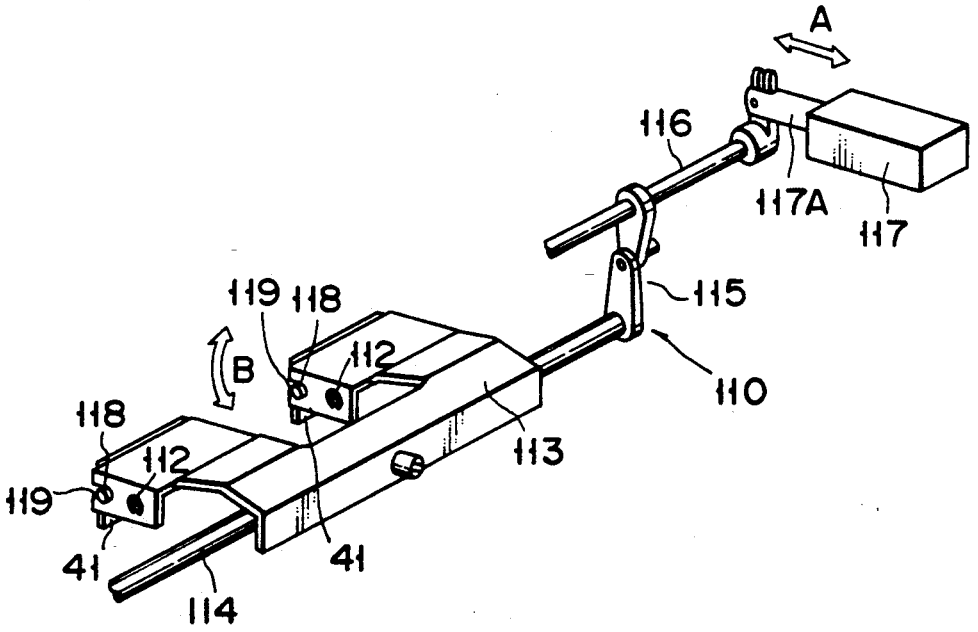
FIG. 7 is a perspective view illustrating a mechanism for moving the second document stopper.

As is shown in FIGS. 6 and 7, a pin 118 protrudes from the holder 111 which holds the second document stopper 41. The pin 118 is set in a notch 119 made in the movable member 113. The holder 111 can rotate around the axle 112 through an angle defined by the difference between the diameter of the pin 118 and the widths of the notch 119.

Figure 8A:
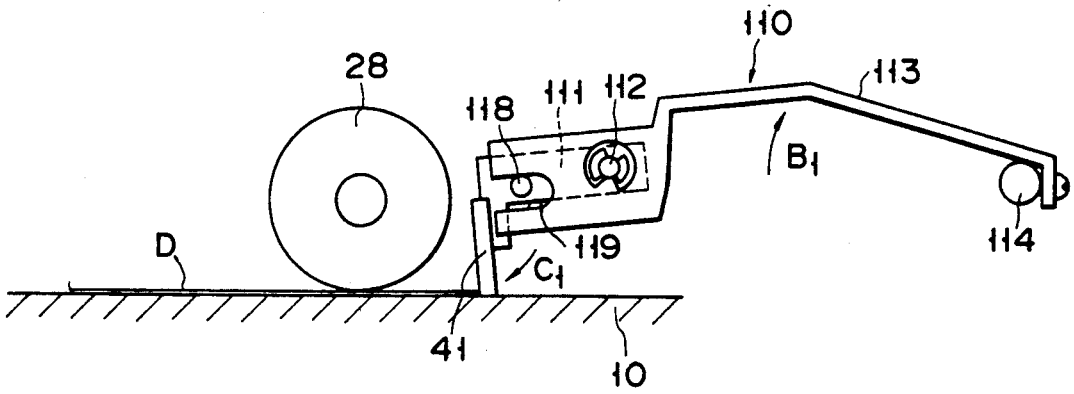
FIG. 8A is a side view of the second document stopper, showing how the stopper operates to position a document sheet on the document table of the image forming apparatus.

When the movable member 11 is rotated in the direction of arrow $B_1$ as is shown in FIG. 8A, thereby bringing the second document stopper 41 into contact with the platen glass 10, the second document stopper 41 rotates slightly in the direction of arrow $C_1$ and contacts the platen glass 10 without fail.

Figure 8B:
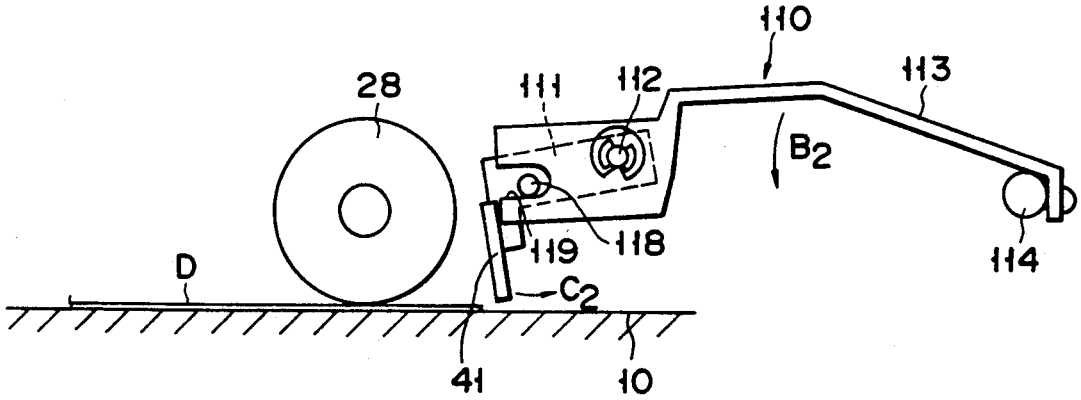
FIG. 8B is a side view of the second document stopper, showing how the stopper operates to feed a document sheet from the document table.

On the other hand, when the movable member 113 is rotated in the direction of arrow B2 as is shown in FIG. 8B, thereby pulling the second document stopper 41 out of contact with the platen glass 10, the second document stopper 41 rotates in the direction of arrow $C_2$ and moves away from the end of the document sheet D placed on the platen glass 10. This reliably prevents the sheet D from curling up as the second document stopper 41 moves upwards, and thus causes the sheet D to be ejected under the second document stopper 41.

The automatic document feeder 2 further comprises an inverter drive mechanism 125 for driving the inverter 43, and a gate drive mechanism 126 for driving the sorting gate 47. These drive mechanisms 125 and 126 will be described, with reference to FIG. 9.

Figure 9:
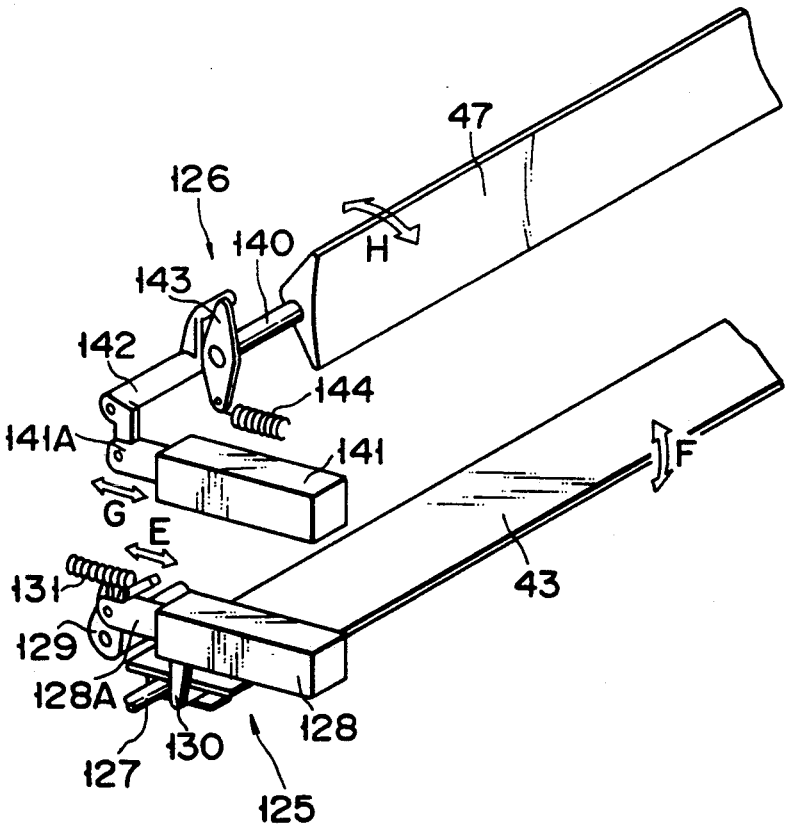
FIG. 9 is a perspective view showing the inverter, the sorting gate, and the mechanism for driving the inverter and the gate (--; all incorporated in the automatic document feeder) and explaining how the mechanism drives the inverter and the sorting gate.

As can be clearly understood from FIG. 9, the inverter 43 rotates around a shaft 127 and is set in engagement with an actuator 130. The actuator 130 is connected to the plunger 128A of a solenoid 128 by means of a transmission 129. As the solenoid 128 is turned on and off, the plunger 128A moves back, in the directions of opposite arrows E. The transmission 129 converts the linear motion of the plunger 128A into the rotation of the inverter 43 in the directions of opposite arrows F. More specifically, when the solenoid 128 is turned on, the right end of the inverter 43 is lowered, and when the solenoid 128 is turned off, the right end of the inverter 43 is lifted due to the force of a spring 131. The document sheet D fed by the register rollers 26 is smoothly supplied to the platen glass 10, and also smoothly guided from the platen glass 10 into the document-ejecting path 42.

The gate drive mechanism 126 will now be described. As is illustrated in FIG. 9, the sorting gate 47 is fastened to a shaft 140 and can rotate around the axis of the shaft 140. A lever 143 is connected to the shaft 140. The lever 143 is connected at its upper end to a transmission 142, which in turn is coupled to the plunger 141A of a solenoid 141. The lower end of the lever 143 is connected to a spring 144. As the solenoid 141 is turned on and off, the plunger 141A reciprocates in the directions of opposite arrows G. The transmission 142 transmits the linear motion of the plunger 141 to the lever 143, whereby the sorting gate 47 is rotated in either direction as is indicated by arrows H. More precisely, when the solenoid 141 is turned on, the sorting gate 47 is rotated to guide the document sheet D into the document-returning path 46. When the solenoid 141 is turned off, the sorting gate 47 is rotated due to the force of the spring 144, to guide the document sheet D into the document ejecting means 45.

Figure 10:
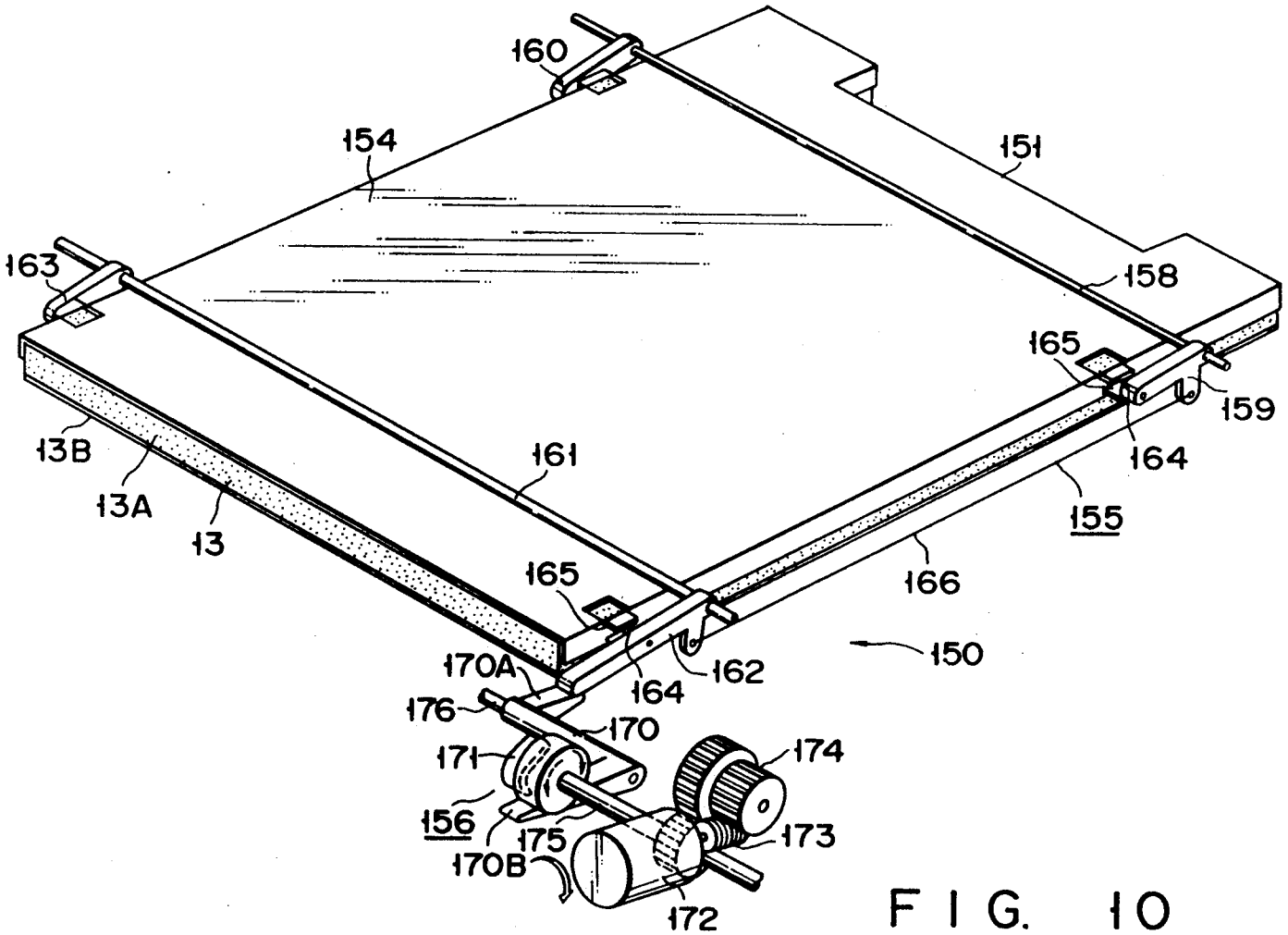
FIG. 10 is a perspective view illustrating the platen sheet and the means for moving the platen sheet, both incorporated in the automatic document feeder.

With reference to FIG. 10, the platen sheet 13 and a platen sheet driving means 150 will be described. As has been described, the platen sheet 13 is located within the document cover 11. The driving means 150 is designed to move the sheet 13 away from the platen glass 10.

The platen sheet 13 is substantially identical to the platen glass 10 in both size and shape. It comprises an elastic sheet 13A made of urethane or the like and a white sheet 13B adhered to the lower surface of the sheet 13A and made of a material having a low friction coefficient. An elongated U-shaped notch 151 is cut in the right side of the platen sheet 13. It is in this notch 151 that one of the document-feeding rollers 28 is partly located. The upper surface of the platen sheet 13 is covered by a cover body 152 (see FIG. 2) which is hinged, at the rear end, to the housing 1 of the image forming apparatus.

The platen sheet driving means 150, which serves to provide a gap between the platen glass 10 and the document cover 11, is designed to drive the platen sheet 13 in a vertical direction, while maintaining the sheet 13 in a horizontal position. When set at its lower position, the platen sheet 13 uniformly contacts the platen glass 10. When the sheet 13 is set at its upper position, a gap is formed between the platen glass 10 and the platen sheet 13.

As is shown in FIG. 10, the platen sheet driving means 150 comprises a movable frame 154, a parallel link mechanism 155, and a link actuating mechanism 156. The movable frame 154 holds the platen sheet 13; the sheet 13 is adhered to the frame 154. The frame 154 has projections 165 protruding outwards from the opposing sides. Each projection 165 has been formed from a portion of either side by pulling this portion up and bending it by 180 degrees. The parallel link mechanism 155 has a first shaft 158, arms 159 and 160, a second shaft 161, arms 162 and 163, and pins 164. The first shaft 158 extends horizontally in the cover body 152 and can rotate. The arms 159 and 160 are fixed to the end portions of the first shaft 158. Similarly, the second shaft 161 extends horizontally in the cover body 152 and parallel to the first shaft 158 and can rotate. The arms 162 and 163 are fixed to the end portions of the second shaft 161. The pins 164 protrude from the arms 159, 160, 162, and 163, respectively, and are set in engagement with the projections 165 protruding from the opposing sides of the movable frame 154.

The arms 159 and 162 fixed to the shafts 158 and 161, respectively, are connected by a connecting wire 166. Similarly, the arms 160 and 163 fixed to the shafts 158 and 161 are connected by a connecting wire (not shown). When the free end of the arm 162 secured to the second shaft 161 is pushed upward the platen sheet 13 is moved upwards, while remaining in the horizontal position, against the force of a spring (not shown) which biases the platen sheet 13 downwards.

The link actuating mechanism 156 will now be described, also with reference to FIG. 10. A crank-shaped rotary member 170 is arranged in the vicinity of the arm 162. A lever 170A is fastened to one end of the rotary member 170 and opposes the lower surface of the free-end portion of the arm 162. A lever 170B is fastened to the other end of the rotary member 170 and opposes the lower surface of a cam 171. The cam 171 is connected to a platen motor 172 by a transmission comprising a worm gear 173, gears 174, and a shaft 175. Hence, the driving force of the platen motor 172 is transmitted to the cam 171.

When the shaft of the platen motor 172 rotates in one direction, the cam 171 is rotated in the direction of the solid-line arrow. As a result of this, the crank-shaped rotary member 170 is rotated around the axis of the shaft 176, pushing up the free end of the arm 162. The platen sheet 13 is therefore lifted while remaining in its horizontal position, and a uniform gap is maintained between the platen glass 10 and the platen sheet 13.

When the shaft of the platen motor 172 rotates in the opposite direction, the cam 171 is rotated in the direction of the broken-line arrow. Hence, the rotary member 170 is rotated around the axis of the shaft 176, moving downwards away from the free end of the arm 162. As a result, the platen sheet 13 is lower because of the downward pull of a spring (not shown) until it contacts the platen glass 10.

Figure 11:
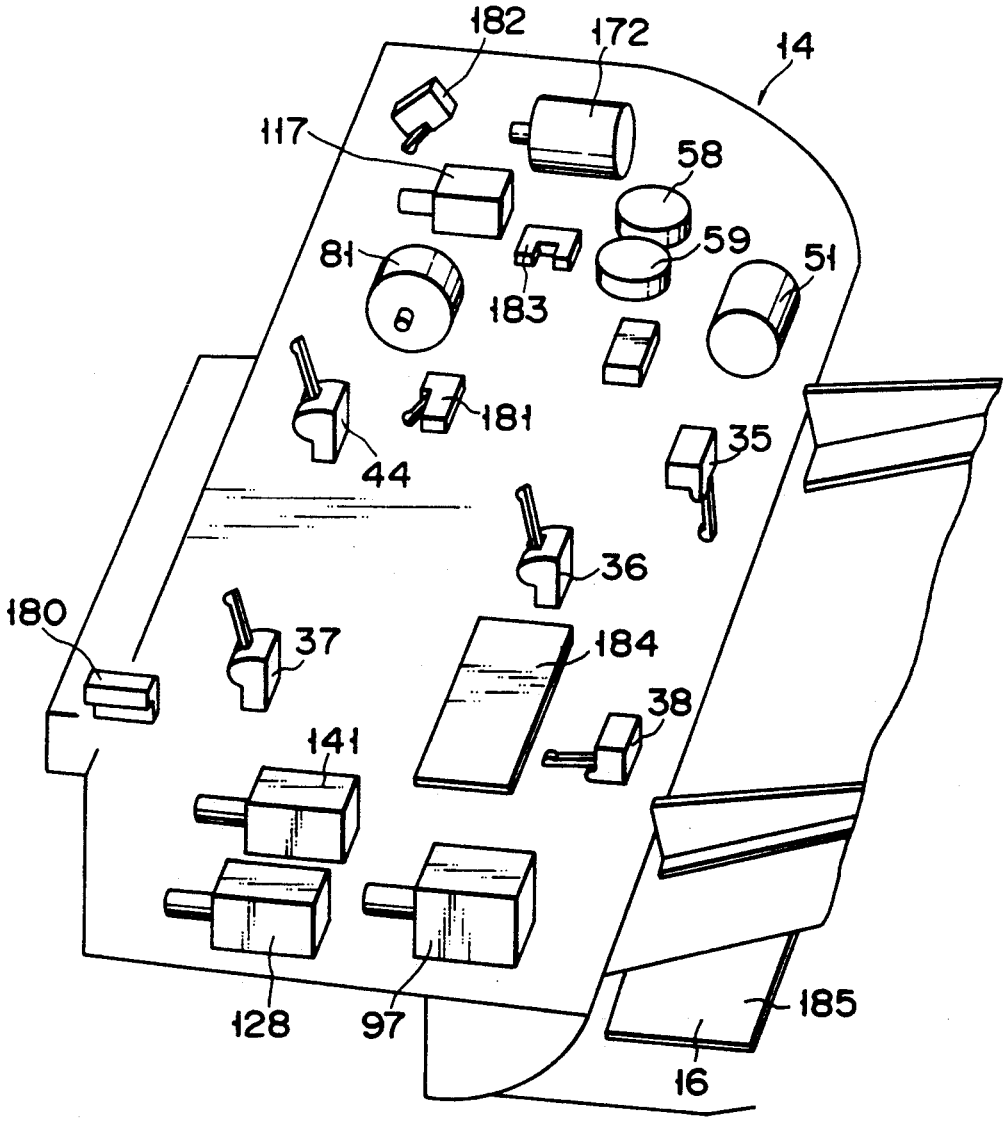
FIG. 11 is a perspective view of the documentfeeding section of the automatic document feeder, illustrating the electronic components arranged on the document-feeding section.

The document-feeding section 14 includes various electronic components. More specifically, as is shown in FIG. 11, it has a platen switch 180, a door switch 181, a cam switch 182, a lever switch 183, control chips 184 and 185, and the like. Also shown in FIG. 11 are the motors 51, 81 and 172 and switches 35, 36, 37, 38 and 44; all having been described above.

Figure 12:
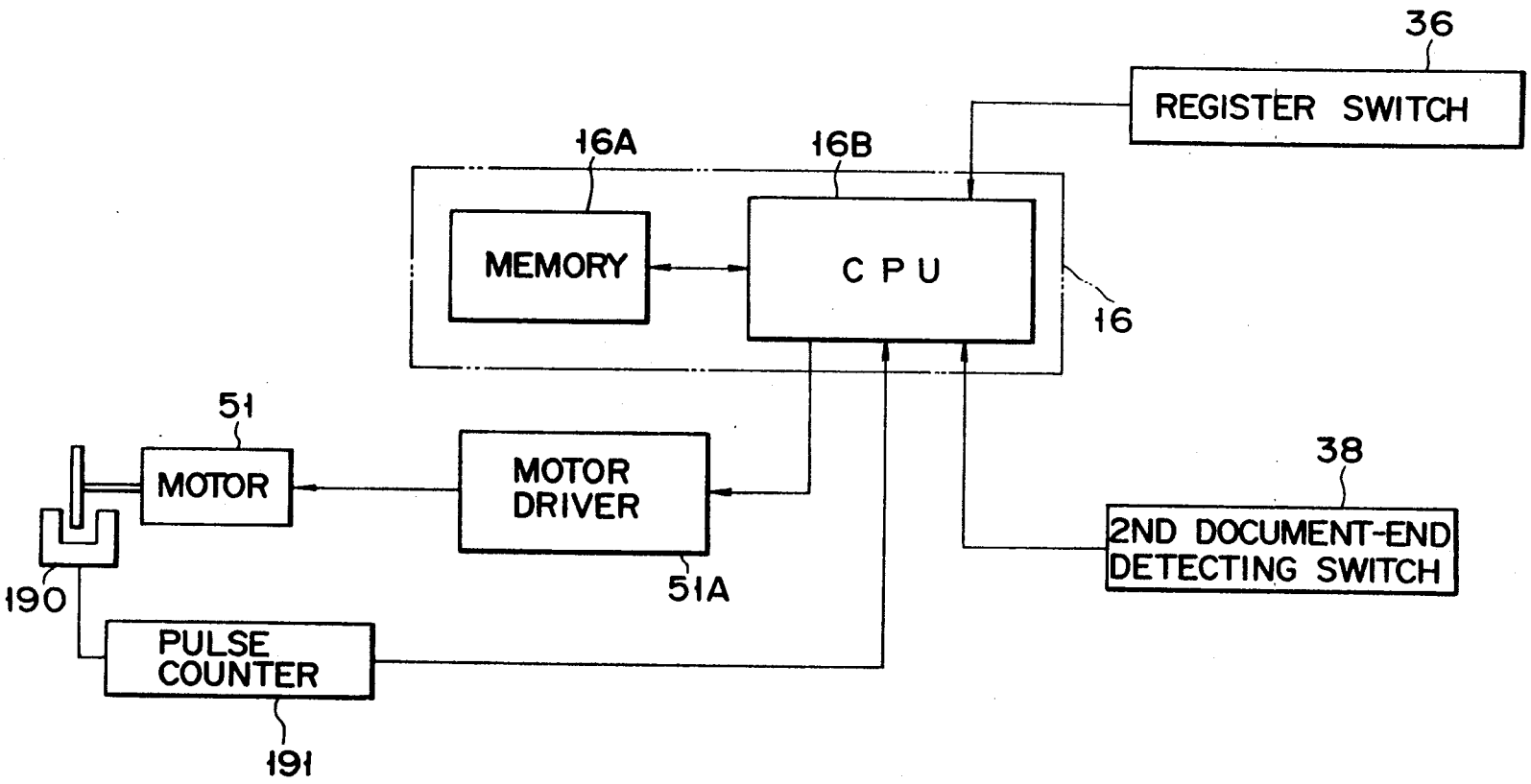
FIG. 12 is a block diagram showing the control system incorporated in the automatic document feeder, for controlling the rotation speed of the register rollers.

FIG. 12 is a schematic representation of the control system incorporated in the automatic document feeder 2 for controlling the rotation speed of the register rollers. The control system includes the control section 16. The control section 16 comprises a CPU 16A and a memory 16B. The signal output by the register switch 36 and the signal output by the second document-end detecting switch 38 are input to the CPU 16A. The CPU 16A outputs a drive signal to a driver 51A for the motor 51. A encoder 190 monitors the rotation of the shaft of the motor 51 and generates pulses, which are supplied to a pulse counter 191. The count of the pulse counter 191 is supplied to the CPU 16A.

When the second document-end detecting switch 38 which is located near the document separating means 23, detects the rear edge of a document sheet D, the CPU 16A controls the motor driver 51A such that the speed of the motor 51 is reduced. Further, the CPU 16A stops the motor 51 upon the lapse of a period of a few seconds after the rear edge of the sheet D has left the register switch 36 located at the entrance to the register rollers 26. This period is the sum of the time during which the rear edge of the sheet D is moving from the switch 38 to the switch 36.

As is illustrated in FIG. 2, the brake unit 30 is arranged near the exit of the register rollers 26, for braking the document sheet D being fed. As has been described, the brake unit 30 comprises the upper roller 31A and the lower roller 31B. As the sheet D is fed at high speed through the gap between these rollers 31A and 31B, it is braked in spite of its great inertia. Hence, the document sheet D moves slowly as it passes by the second document-end detecting switch 38. Hence, the time at which the rear edge of the sheet D passes the switch 38 can be reliably detected.

The moment the second document-end detecting switch 38 is actuated, the rear edge of the document sheet D is set at a predetermined position with respect to the document-feeding rollers 26. Therefore, it is possible to stop the sheet D in the gap between the platen glass 10 and the platen sheet 13, with its rear edge located between the second document stopper 41 and the documentfeeding rollers 26. Hence, the document sheet D is made to abut, without fail, against the second document stopper 41, and is correctly positioned on the platen glass 10 so that the entire image formed on the sheet D can be copied.

With reference to the timing chart of FIGS. 13A to 13J, it will be explained how the automatic document feeder 2 operates to feed each document sheet D to the platen glass 10 and eject it therefrom when the image forming apparatus is set in the single-side copying mode.

First, an operator places a stack of document sheets D on first tray 12, each sheet D with its imageformed side turned downward. Then, he or she pushes the copy key (not shown), thereby turning the motor 51 on at time $T_1$ (FIG. 13D). As is shown in FIG. 13E, the pick-up solenoid 97 is turned off at time $T_2$. Simultaneously, the register switch 36 is turned on as is shown in FIG. 13A. Hence, the pick-up roller 20 is rotated, feeding the uppermost document sheet D from the first tray 12.

Next, the solenoid 59 is turned off at time $T_3$, as is illustrated in FIG. 13F. The uppermost document sheet D is fed leftward to the the document separating means 23 which comprises the document-feeding roller 21 and the document-separating roller 22. At this time, the platen sheet driving means 150 lifts the platen sheet 13, thereby forming a gap between the platen glass 10 and the platen sheet 13.

Thereafter, the document sheet D is fed until its front edge abuts the register rollers 26, and is thus correctly positioned at the register rollers 26. The register rollers 26 are rotated at time T4 (FIG. 13G), whereby the document sheet D is further fed to the left. The first document-end detecting switch 37 is turned on at time $T_5$ as is illustrated in FIG. 13B.

Meanwhile, the right end of the inverter 43 is located at its lower position. Hence, the second document stopper 41, which serves as a scale means for positioning each sheet D, and the document-feeding rollers 28 are located at their upper positions. Thus, the document sheet D is further fed to the left.

When the document sheet D passes by the register switch 36 provided at the entrance to the register rollers 26, the switch 36 is turned off at time $T_6$ (FIG. 13A). A few seconds later, that is, the moment the rear edge of the sheet D comes out of the gap between the register rollers 26, the rollers 26 are stopped. Thereafter, the document sheet D is fed by means of the document-feeding rollers 28. Since both the platen glass 10 and the white sheet 13B of the platen sheet 13 are made of materials having low friction coefficients, the sheet D smoothly moves into the gap between the platen glass 10 and the white sheet 13B and is not bent at all, by virtue of its sufficient rigidness.

As has been described, as soon as the second document-end detecting switch 38, which is located at the rear of the document separating means 23, detects the rear edge of the document sheet D, the CPU 16A reduces the speed of the motor 51. As a result of this, the speed at which the sheet D is being fed decreases. Further, the upper roller 31A and lower roller 31B of the brake unit 30, arranged at the exit of the register rollers 26, apply a braking force on the document sheet D. Therefore, despite the inertia of the document sheet D, the sheet D does not pass by the first document-end detecting switch 37 at high speed, but at regular timing.

Next, the motor 51, the register solenoid 58, and the pick-up solenoid 97 are turned off at time $T_7$ *as is shown in FIGS.* 13*D*, 13*E and* 13*G. The motor* 81 *is turned on at time* $T_8$ as is illustrated in FIG. 13H, thus rotating the document-feeding rollers 28, whereby the document sheet D is fed forward.

When the rear edge of the document sheet D passes the first document-end detecting switch 37 at time $T_9$ (FIG. 13B), the first document-end detecting switch 37 is turned off. Then, the motor 81 is stopped at time $T_{10}$ (FIG. 13H). The document-feeding rollers 28 stop after rotating through an angle corresponding to a predetermined number of drive pulses. In other words, the sheet D is fed until its rear edge reaches a position at a distance L from the first document-end detecting switch 37, so that its rear edge is located between the second document stopper 41 and the document-feeding rollers 28. Then, the solenoid 117 is turned on at time $T_{10}$ (FIG. 13I), whereby the second document stopper 41 is lowered to contact the platen glass 10 as is illustrated in FIG. 8A.

At time $T_{11}$ (FIG. 13H), the motor 81 is turned on and is driven in the reverse direction, rotating the document-feeding rollers 28 in the reverse direction. The first document sheet D is therefore moved and abuts against the second document stopper 41. At time $T_{12}$ (FIG. 13H), the motor 81 is turned off. The platen sheet 13 is lowered, pressing and holding the document sheet D set at a correct position on the platen glass 10. The first document sheet D is scanned by the image-forming system (not shown) incorporated in the image-forming apparatus 2.

Upon completion of the scanning of the document sheet D, the solenoid 117 is turned off at time T13 as is shown in FIG. 13I. As a result of this, the second document stopper 41 moves upward, moving the right end of the inverter 43 to its upper position. At the same time, the platen sheet 13 is lifted, thus forming a gap between the platen glass 10 and the platen sheet 13.

As is illustrated in FIGS. 13D and 23E, the motor 51 and the solenoid 59 are turned on, whereby the second document sheet D, which is now the uppermost one, is fed from the first tray 12. The register switch 36 is turned on at time $T_{14}$ (FIG. 13A). Upon lapse of a predetermined time thereafter, or at time $T_{15}$ (FIG. 13D), the motor 51, the pick-up solenoid 97, and the solenoid 59 are turned off, whereby the feeding of the second document sheet D is suspended.

At time $T_{16}$ (FIG. 13J), the image-forming system finishes copying the image on the first document sheet D placed on the platen glass 10. Then, the solenoid 97 is turned on at time $T_{17}$ as is shown in FIG. 13F. The motor 81 is turned on at time $T_{18}$ (FIG. 13H), whereby the document-feeding rollers 28 are rotated in the reverse direction, whereby the first document sheet D is fed to the right (FIG. 2) and guided into the document ejecting path 42 by means of the inverter 43. The first document sheet D is further guided by the sorting gate 47 and fed by the document ejecting means 45 into the second tray 15 (FIG. 1).

As is illustrated in FIG. 13C, the gate switch 44 is turned on at time $T_{20}$ and turned off at time $T_{25}$, whereby it is ascertained that the first document sheet D has been ejected into the second tray 15.

Meanwhile, at time $T_{19}$ (FIG. 13D), or upon lapse of a predetermined time after the pick-up solenoid 97 has been turned on at time $T_{17}$ (FIG. 13E), the motor 51 is turned on, whereby the second document sheet D is further fed toward the left.

Thereafter, the motor 81 is turned on at time $T_{26}$, as is shown in FIG. 13H, and the motor 51 is turned off at time $T_{27}$ as is illustrated in FIG. 13D. Then, at time $T_{28}$ (FIG. 13B), the first document-end detecting switch 37 is turned off. A predetermined time there after, or at time $T_{29}$ (FIG. 13H), the motor 81 is turned off. Therefore, the document-feeding rollers 28 stop after rotating through an angle corresponding to the predetermined number of drive pulses. As a result of this, the sheet D is fed until its rear edge reaches a position at a distance L from the first document-end detecting switch 37, so that its rear edge is located between the second document stopper 41 and the document-feeding rollers 28. Then, the solenoid 117 is turned on at time $T_{29}$ (FIG. 13I), whereby the second document stopper 41 is lowered to contact the platen glass 10 as is illustrated in FIG. 8A.

At time $T_{30}$ (FIG. 13H), the motor 81 is turned on and is driven in the reverse direction, rotating the document-feeding rollers 28 in the reverse direction. The second document sheet D is therefore moved and abuts against the second document stopper 41. At time $T_{31}$ (FIG. 13H), the motor 81 is turned off. The platen sheet 13 is lowered, pressing and holding the document sheet D set at a correct position on the platen glass 10. The second document sheet D is scanned by the image-forming system (not shown) incorporated in the image-forming apparatus 2.

Upon completion of the scanning of the second document sheet D, the solenoid 117 is turned off at time $T_{32}$ as is shown in FIG. 13I. Also at time $T_{32}$ (FIG. 13E), the pick-up solenoid 97 is turned of at time $T_{32}$. The second document stopper 41 moves upward, moving the right end of the inverter 43 to its upper position. Simultaneously, the platen sheet 13 is lifted, thus forming a gap between the platen glass 10 and the platen sheet 13.

Upon lapse of a predetermined period thereafter, or at time $T_{34}$ (FIG. 13E), the pick-up solenoid 97 is turned on. Then, the motor 81 is turned on at time $T_{35}$ as is illustrated in FIG. 13H, whereby the document-feeding rollers 28 are rotated in the reverse direction, thus feeding the second document sheet D to the right (FIG. 2).

Then, the motor 51 is turned on at time $T_{36}$ (FIG. 13D), and the gate switch 44 is turned on at time $T_{37}$ (FIG. 13C). Thereafter, the pick-up solenoid 97 is turned off at time $T_{38}$ as is illustrated in FIG. 13E. Further, the gate switch 44 is turned off at time $T_{40}$ (FIG. 13C) after the motor 81 has been turned on at time $T_{35}$. And the motor 51 is turned off at time $T_{41}$ as is shown in FIG. 13D.

The image-forming system (not shown) incorporated in the image forming apparatus operates during the period $T_{26}$ to $T_{33}$, thereby copying the image on the second document sheet D correctly positioned on the glass platen 10.

With reference to the timing chart of FIGS. 14A to 4J, it will be explained how the automatic document feeder 2 operates to feed each document sheet D from the first tray 12 to the platen glass 10, and then eject it from the platen glass 10 into the second tray 15, when the image forming apparatus is set in the double-side copying mode.

First, an operator places a stack of document sheets D on first tray 12, each sheet D with its imageformed side turned downward. Then, he or she pushes the copy key (not shown), thereby turning the motor 51 on at time $T_1$ (FIG. 14D). As is shown in FIG. 14E, the pick-up solenoid 97 is turned off at time $T_2$. Simultaneously, the register switch 36 is turned on as is shown in FIG. 14A. Hence, the pick-up roller 20 is rotated, feeding the uppermost document sheet D from the first tray 12.

Next, the solenoid 59 is turned off at time $T_3$, as is illustrated in FIG. 14F. The uppermost document sheet D is fed leftward to the the document separating means 23 which comprises the document-feeding roller 21 and the document-separating roller 22. At this time, the platen sheet driving means 150 (FIG. 10) lifts the platen sheet 13, thereby forming a gap between the platen glass 10 and the platen sheet 13.

Thereafter, the document sheet D is fed until its front edge, abuts the register rollers 26 which remain stopped, and is thus correctly positioned at the register rollers 26. The register rollers 26 are rotated at time $T_4$ (FIG. 14G), whereby the document sheet D is further fed to the left. The document-end detecting switch 37 is turned on.

Meanwhile, the right end of the inverter 43 is located at its lower position. Hence, the second document stopper 41, which serves as a scale means for positioning each sheet D, and the document-feeding rollers 28 are located at their upper positions. Thus, the document sheet D is further fed to the left, slipping on the platen glass 10.

When the document sheet D passes by the register switch 36 provided at the entrance to the register rollers 26, the switch 36 is turned off at time T5 (FIG. 14A). A few seconds later, that is, the moment the rear edge of the sheet D comes out of the gap between the register rollers 26, the rollers 26 are stopped. Thereafter, the document sheet D is fed by means of the document-feeding rollers 28. Since both the platen glass 10 and the white sheet 3B of the platen sheet 13 are made of materials having low friction coefficients, the sheet D smoothly moves into the gap between the platen glass 10 and the white sheet 13B and is not bent at all, by virtue of its sufficient rigidness.

As has been described with reference to FIG. 12, as soon as the second document-end detecting switch 38, which is located at the rear of the document separating means 23, detects the rear edge of the document sheet D, the CPU 16A reduces the speed of the motor 51. As a result of this, the speed at which the sheet D is being fed decreases. Further, the upper roller 30A and lower roller 30B of the brake unit 30, arranged at the exit of the register rollers 26, apply a braking force on the document sheet D. Therefore, the document sheet D does not pass by the first document-end detecting switch 37 despite the inertia of the sheet D.

Next, the motor 51, the register solenoid 58, and the pick-up solenoid 97 are turned off at time T5 as is shown in FIGS. 14D, 14E and 14G. The motor 81 is turned on at time $T_6$ as is illustrated in FIG. 14H, thus rotating the document-feeding rollers 28, whereby the document sheet D is fed forward.

When the rear edge of the document sheet D passes the first document-end detecting switch 37 at time $T_7$ (FIG. 14B), the document-end detecting switch 37 is turned off. Then, the motor 81 is stopped at time $T_8$ (FIG. 14H). The document-feeding rollers 28 stop after rotating through an angle corresponding to a predetermined number of drive pulses.

The motor 81 is turned on at time $T_9$ as is shown in FIG. 14H, thus rotating the document-feeding rollers 28 in the reverse direction. Hence, the document sheet D is fed to the right, without undergoing copying process. The sheet D is guided into the document ejecting path 42 by means of the inverter 43. It is further guided into the document-returning path 46, and is therefore turned up-side down by means of the sorting gate 47. The document sheet D is then guided to the input-side of the register rollers 26. The motor 81 is turned off at time $T_{10}$ (FIG. 14H). The motor 81 is again turned on at time $T_{11}$ (FIG. 14H), and driven in the reverse direction. Then, it is turned off at time $T_{13}$ (FIG. 14H).

In the meantime, the gate switch 44, the motor 51, and the register solenoid 58 are turned off at time $T_{12}$ as is illustrated in FIGS. 14C, 14D, and 14G. There after, at time $T_{14}$ (FIG. 14E), the pick-up solenoid 97 is turned off. At time $T_{15}$ (FIG. 14A), the register switch 36 is turned on.

Thereafter, the first document-end detecting switch 37 is turned on at time $T_{16}$ as is shown in FIG. 14B. The gate switch 44 is turned off at time $T_{17}$ as is illustrated in FIG. 14C.

Upon lapse of a predetermined time, the register switch 36,the motor 51, the pick-up solenoid 97, and the register solenoid 58 are turned off, off, on, and off at time $T_{18}$, respectively, as is shown in FIGS. 14A, 14D, 14E, and 14D. Then, at time $T_{20}$ (FIG. 14H), the motor 81 is turned on, whereby the document sheet D is further fed.

When the rear edge of the document sheet D passes the document-end detecting switch 37 at time $T_{21}$ (FIG. 14B), the document-end detecting switch 37 is turned off. Then, the motor 81 is stopped at time $T_{22}$ (FIG. 14H). The document-feeding rollers 28 stop after rotating through an angle corresponding to a predetermined number of drive pulses.

As a result of this, the sheet D is fed until its rear edge reaches a position at a distance L from the document-end detecting switch 37, so that its rear edge is located between the second document stopper 41 and the document-feeding rollers 28. Then, the solenoid 117 is turned on at time $T_{22}$ (FIG. 14I), whereby the second document stopper 41 is lowered to contact the platen glass 10 as is illustrated in FIG. 8A.

At time $T_{23}$ (FIG. 14H), the motor 81 is turned on and is driven in the reverse direction, rotating the document-feeding rollers 28 in the reverse direction. The document sheet D is therefore moved and abuts against the document stopper 41. At time $T_{24}$ (FIG. 14H), the motor 81 is turned off. The platen sheet 13 is lowered, pressing and holding the document sheet D set at a correct position on the platen glass 10, with its obverse side turned up. Therefore, the reverse side of the document sheet D is scanned by the image-forming system not shown) incorporated in the image-forming apparatus 2.

Upon completion of the scanning of the reverse side of the document sheet D, the solenoid 117 is turned off at time $T_{25}$ as is shown in FIG. 14I. The document stopper 41 moves upward, moving the right end of the inverter 43 to its upper position. Simultaneously, the platen sheet 13 is lifted, thus forming a gap between the platen glass 10 and the platen sheet 13. Also at time $T_{25}$ (FIG. 14E), the pick-up solenoid 97 is turned off.

At time $T_{27}$ (FIG. 14H), the motor 81 is turned on, rotating the document-feeding rollers 28 in the reverse direction, whereby the document sheet D is fed to the right (FIG. 2). Upon lapse of a predetermined time, or at time $T_{30}$ (FIG. 14H), the motor 81 is turned off.

The pick-up solenoid 97 is turned off at time $T_{31}$ as is illustrated in FIG. 14E. A predetermined time thereafter, at time $T_{32}$ (FIGS. 14A and 14B), the document-end detecting switch 37 is turned on. Upon lapse of a predetermined period, or at time $T_{33}$ (FIG. 14C), the gate switch 44 is turned off.

At time $T_{34}$ (FIGS. 14A, 14D, 14D, 14G), the register switch 36, the motor 51, pick-up solenoid 97, and the register solenoid 58 are turned off, off, on, and off, respectively. Then, the motor 81 is turned on at time T36 as is shown in FIG. 14H.

When the rear edge of the document sheet D passes the document-end detecting switch 37 at time $T_{37}$ (FIG. 14B), the document-end detecting switch 37 is turned off. Then, the motor 81 is stopped at time T38 (FIG. 14H). The document-feeding rollers 28 stop after rotating through an angle corresponding to a predetermined number of drive pulses.

As a result of this, the sheet D is fed until its rear edge reaches a position at a distance L from the document-end detecting switch 37, so that its rear edge is located between the second document stopper 41 and the document-feeding rollers 28. Then, the solenoid 117 is turned on at time $T_{38}$ (FIG. 14I), whereby the second document stopper 41 is lowered to contact the platen glass 10 as is illustrated in FIG. 8A.

At time $T_{39}$ (FIG. 14H), the motor 81 is turned on and is driven in the reverse direction, rotating the document-feeding rollers 28 in the reverse direction. The document sheet D is therefore moved and abuts against the document stopper 41. At time $T_{41}$ (FIG. 14H), the motor 81 is turned off. The platen sheet 13 is lowered, pressing and holding the document sheet D set at a correct position on the platen glass 10, with its reverse side turned up. Hence, the obverse side of the document sheet D is scanned by the image-forming system (not shown) incorporated in the image-forming apparatus 2.

Upon completion of the scanning of the obverse side of the document sheet D, the solenoid 117 is turned off at time $T_{32}$ as is shown in FIG. 14I. The first document stopper 41 moves upward, moving the right end of the inverter 43 to its upper position. Simultaneously, the platen sheet 13 is lifted, thus forming a gap between the platen glass 10 and the platen sheet 13. Also at time $T_{32}$ (FIG. 14E), the pick-up solenoid 97 is turned off.

Upon lapse of a predetermined time, or at time $T_{43}$ (FIG. 14H), the pick-up solenoid 97 is turned on. The motor 81 is turned on at time $T_{44}$ (FIG. 14H).

As may be understood from FIGS. 14A to 14J, the image on the reverse side of the document sheet D is copied during the period from time $T_{19}$ to time $T_{26}$, whereas the obverse side of the sheet D is copied during the period from time $T_{35}$ to time $T_{42}$.

When the image forming apparatus is set to the double-side copying mode, each document sheet D is first fed onto the platen glass 10 and ejected into the document ejecting path 42, without undergoing copying process. The sheet D is then guided by the sorting gate into the document returning path 46, and turned up-side down therein. The document sheet D, thus turned up-side down, is guided to the register rollers 26 and correctly positioned on the platen glass 10, with its obverse side turned up. Thus, the image on the reverse side of the sheet D is first copied. Thereafter, the document sheet D is guided into the document returning path 46 and turned up-side down again. It is fed back to the register rollers 16, and correctly positioned, with its reverse side turned up. This time, the image on the obverse side is copied.

The document sheet D, both sides of which have been copied, is ejected into the second tray 15 (FIG. 1). Since the reverse side of each document sheet D is first copied, and the obverse side is then copied, the document sheets D will be piled on the second tray 15 in the correct page-order.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An automatic document feeder comprising:

first means for feeding document sheets, one by one, from a document-containing portion;

means for guiding each of the document sheets fed by said first means;

second means for feeding each of the document sheets fed by said first means through said guiding means, in a first direction, so as to exert inertia on each of the document sheets;

means for detecting each of the document sheets fed by said second means and for generating a signal upon detecting each of the document sheets, said detecting means being located near said second means;

means for braking the inertia of each of the document sheets, said braking means being located at an exit side of said second means;

means for supporting each of the document sheets fed by said second means;

third means, having document feeding rollers, for feeding each of the document sheets supported by said supporting means, in a second direction which is opposite to the first direction, in accordance with the signal generated by said detecting means, said rollers being separated from said supporting means while each of the document sheets is being fed by said second means, and bearing against said supporting means with each of the document sheets interposed while each of the document sheets is being fed by said third means; and means for automatically pressing onto said supporting means each of the document sheets fed by said third means, said pressing means opposing said supporting means.

2. An automatic document feeder according to claim 1, wherein said second means includes register rollers, and said braking means is located at an exit side of said register rollers.

3. An automatic document feeder according to claim 2, wherein said braking means has a first roller and a second roller put in rolling contact with the first roller.

4. An automatic document feeder according to claim 2, further comprising:

means for feeding the document sheet to said supporting means and ejecting the document sheet therefrom after the document sheet has been subjected to a copying process;

means for positioning a document, said positioning means being located in the vicinity of said document-feeding means; and means for driving said positioning means, said driving means comprising:

means having a plurality of fulcrums, for moving said positioning means away from an edge of the document sheet supported on said supporting means before the document sheet is ejected from said supporting means.

5. An automatic document feeder according to claim 1, wherein said document feeder further comprises:

means for driving said pressing means to and away from said supporting means, said driving means including:

a drive-power source located within a housing of an image forming apparatus;

a cam driven by said drive-powr source;

a rotary member which rotates as said cam is driven by said drive-power source; and a link mechanism for moving said pressing means to and away from said supporting means as said rotary member rotates; and means for feeding the document sheet into a gap between said supporting means and said pressing means moved by said driving means.

6. An automatic document feeder comprising:

first means for feeding document sheets in a first direction;

means for detecting each of the document sheets fed by said first means;

means for reducing the speed at which said first feeding means feeds each of the document sheets in relationship with the detection of said detecting means;

means for supporting each of the document sheets fed by said first means;

second means for feeding each of the document sheets supported by said supporting means, in a second direction which is opposite to the first direction, said second means being separated from said supporting means while each of the document sheets is being fed by said first means, and bearing against said supporting means with each of the document sheets interposed while each of the document sheets is being fed by said second means; and means for positioning each of the document sheets fed by said second means at a predetermined position on said supporting means.

7. An automatic document feeder according to claim 6, wherein:

said first means includes register rollers for feeding each of the document sheets at a predetermined timing;

said detecting means includes a switch, located near the register rollers, for detecting each of the document sheets fed by said register rollers and for generating a signal upon detecting each of the document sheets;

said second means including feeding rollers for feeding and placing each of the document sheets fed by said register rollers at a predetermined position on said supporting means, in accordance with the signal generated by said switch; and said reducing means including a controller for reducing the speed at which said register rollers feed each of the document sheets, when the document sheet reaches the predetermined position on said supporting means.

8. An automatic document feeder which comprises:

first means for feeding document sheets, one by one, from a document-containing portion in a first direction;

means for supporting each of the document sheets fed by said first feeding means;

means for detecting each of the document sheets fed by said first feeding means and for generating a signal upon detecting each of the document sheets;

means for reducing the speed at which said first feeding means feeds each of the document sheets, when each of the document sheets reaches a predetermined position on said supporting means;

second means for feeding each of the document sheets supported by said supporting means in accordance with the signal generated by said detecting means, in a second direction which is opposite to the first direction, said second means being separated from said supporting means while each of the document sheets is being fed by said first means, and bearing against said supporting means with each of the document sheets interposed while each of the document sheets is being fed by said second means;

means for positioning each of the document sheets fed by said first means at the predetermined position on said supporting means;

means for pressing onto said supporting means each of the document sheets fed by said second means, said pressing means opposing said supporting means; and means for inverting each of the document sheets fed from said supporting means and feeding the same back to said first feeding means.

9. An automatic document feeder according to claim 8, wherein said first feeding means has register rollers, and said document-inverting means has means for inverting each document sheet fed from said supporting means and feeding the same back to an input side of said register rollers.

10. An image forming apparatus, comprising:

first means for feeding document sheets, in a first direction;

means for supporting each of the document sheets fed by said first means;

means for detecting each of the document sheets fed by said first means;

means for reducing the speed at which said feeding means feeds each of the document sheets in relationship with the detection of said detecting means;

second means for feeding each of the document sheets supported by said supporting means, in a second direction which is opposite to the first direction, said second means being separated from said supporting means while each of the document sheets is being fed by said first means, and bearing against said supporting means with each of the document sheets interposed while each of the document sheets is being fed by said second means; and means for forming an image on an image bearing member in accordance with an image of a respective one of the document sheets in the predetermined portion.

* * * * *